United States Patent [19]

Yamada

[11] 4,231,271

[45] Nov. 4, 1980

[54] ATTACHMENT FOR BOLT TIGHTENING AND REMOVING DEVICE

[76] Inventor: Keiichi Yamada, 20-19, Hancho 4-Chome, Minou-Shi Osaka Prefecture, Japan

[21] Appl. No.: 971,053

[22] Filed: Dec. 19, 1978

Related U.S. Application Data

[63] Continuation-in-part of Ser. No. 788,308, Apr. 18, 1977.

[30] Foreign Application Priority Data

Dec. 21, 1977 [JP] Japan ..... 52-173075[U]

[51] Int. Cl.[3] ..... B25B 17/00

[52] U.S. Cl. ..... 81/57.3

[58] Field of Search ..... 81/57.3, 57.39

[56] References Cited

U.S. PATENT DOCUMENTS

| | | | |
|---|---|---|---|
| 1,648,134 | 11/1927 | Kientz | 81/57.3 |
| 2,572,297 | 10/1951 | Able et al. | 81/57.3 |
| 2,746,331 | 5/1956 | Andersen | 81/57.3 |
| 3,258,999 | 7/1966 | Scheithayer et al. | 81/57.3 |
| 3,706,244 | 12/1972 | Wilmeth | 81/57.39 |
| 3,714,852 | 2/1973 | Giangrasso | 81/57.3 |
| 4,027,560 | 6/1977 | Parker | 81/57.39 |

FOREIGN PATENT DOCUMENTS

| | | | |
|---|---|---|---|
| 620231 | 1/1927 | France | 81/57.3 |

*Primary Examiner*—James L. Jones, Jr.

[57] ABSTRACT

Attachment for a tightening and removing device of objects such as bolts, nuts and the like, for transmitting the turning force of the device to the objects when disposed in the innermost section of a narrow gap, comprising reaction force receiving means to definitely receive the reaction force generated in the attachment during a fastening and removing operation of the objects when the turning force inputted from the device is transmitted to those objects.

8 Claims, 13 Drawing Figures

ATTACHMENT FOR BOLT TIGHTENING AND REMOVING DEVICE

This is a continuation-in-part of the same inventor's co-pending patent application Ser. No. 788,308, filed on Apr. 18, 1977, titled "Attachment for a Torque Wrench".

The present invention relates to an improved attachment, usable particularly when carrying out fastening and removing operations on or with objects such as bolts, nuts and the like disposed in innermost sections of narrow gaps, by applying a turning force generated when a handle is turned manually or electrically, and transmits the force to a socket that holds the bolt head or the nut.

The objects such as bolts and the like are not always exposed on the surface of the machine and the like, and there may be a case wherein the objects are positioned inside the machine so that the attaching and detaching operations on the objects must be carried out by inserting the tightening and removing device such as a torque wrench and the like in a narrow gap. Even if the device may be inserted deep enough to reach the objects, nevertheless the amount of turning the device is limited considerably due to the narrow gap. It is therefore a disadvantage that rapid and easy operations cannot be carried out.

When such operations are applied to objects such as bolts and the like of underground pipes such as sewer pipes at the joints thereof, there is no place at all in the narrow gap between the pipe and the ground to permit the turning of the tightening and removing device, so that the latter cannot be utilized. This brings about the disadvantage that the channel that holds the pipe must be dug deeper at the joint.

To resolve the above-mentioned problem, among others an attachment has been contrived for fastening and removing objects such as bolts, nuts and the like, as disclosed in U.S. Pat. No. 3,714,852 of Feb. 6, 1973 to J. A. Giangrasso: "Power Transfer Device". A short explanation with respect to the structure of this attachment or device is given as follows. Two chain wheels are journaled at the ends of an elongated metal housing and an endless chain interconnects the wheels. In its use the operator inserts the attachment in a narrow gap and positions it between the bolt or nut and the tightening and removing device in order to transmit turning force from the device to the socket which holds the bolt or nut through the attachment.

However, in this kind of attachment where the reaction force is generated as a result of the turning force of the device, being transmitted to the socket, and the reaction force itself, makes the attachment and the device rotate together as a single body to cause such a problem that the fastening and removing force cannot be transmitted to the bolt or nut through the socket.

Consequently, the major object of the present invention is to provide an attachment for tightening and removing devices, adapted to fasten or remove objects such as bolts or nuts, equipped with novel reaction force receiving means so that the operator can keep the attachment with his hands in a certain position against the reaction force.

In a device for fastening and removing bolts and nuts and the like, not of a type wherein the turning force is generated manually to be transmitted to the attachment, but of a type wherein a motor converts electricity into the turning force, input torque is great to increase the reaction force, largely in accordance with the torque, to the extent that it becomes difficult for the operator to keep the attachment in a certain position against the reaction force.

Accordingly, another object of the present invention is to provide an attachment for a device to fasten and remove the objects, equipped with reaction force receiving means, which ensures the fastening and removing operations on the objects, making the operator receive the reaction force on the attachment generated when the turning force is transmitted thereto, and not making the member itself receive it, which holds the objects.

Further objects, inventive features as well as advantages thereof will become clear from the detailed description that follows, when considered in conjunction with the accompanying drawings, wherein FIG. 1 is an elevation of the external appearance of a first embodiment of the inventive attachment for tightening and removing devices;

Figure 1:
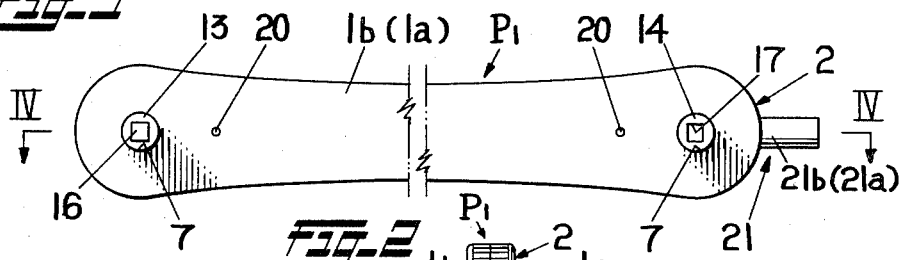
Figure 2:
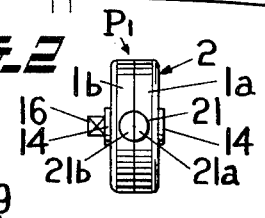
FIG. 2 is a side view of the same.
Figure 3:
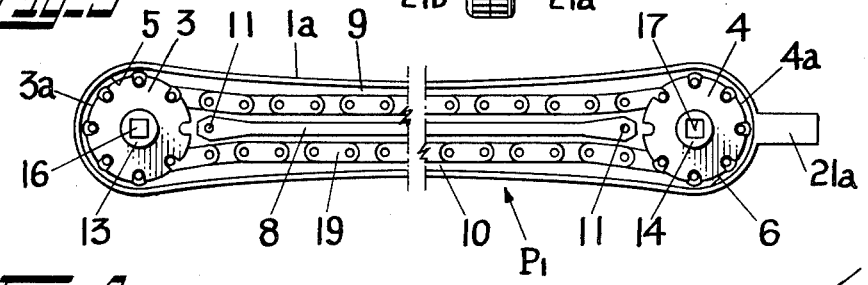
FIG. 3 is a view showing the internal structure of the same when a cover is removed.

A first exemplary embodiment of an inventive attachment P1 shown in FIGS. 1 to 4 consists of metal or steel, which may be applied to a torque wrench 18 (see FIGS. 4, 6) of a type wherein turning force is generated by manual operation. An elongated casing 2 is constructed with a pair of elements 1*a*, 1*b* having a symmetrical shape. Each element is constructed at its ends with recessed portions 5, 6 for mounting chain wheels or sprockets 3, 4 to be described later, while the center portions of the recessed portions have boss bores or holes 7 therein.

Furthermore, projecting strips 8 are positioned as a chain guide between the recessed portions 5, 6, intermediate the casing elements 1*a*, 1*b*. This results in a pair of chain guide channels 9, 10 connecting the portions 5, 6 on both sides of strips 8. In positions at the ends of the strip 8 of the casing element 1*a* there are holes 11 on one side for inserting bolts.

On the other hand, tapped holes 12 are provided in the casing element 1*b* that correspond thereto. The wheels 3, 4 are equal in diameter, and on the peripheral surfaces thereof are formed two sets of parallel teeth 3*a*, 4*a* while bosses 13, 14 protrude on the respective ends.

The boss 13 has a square shaft 16 on one end, for mounting a socket 15, and on the other end the boss 14 has a square hole 17 which passes from right to left throughout the chain wheel 4. This square hole is for mounting the torque wrench 18, and the way of using these parts will be apparent from the explanations given hereunder.

The wheels 3, 4 are mounted in the spaces between the portions 5, 6 of the casing elements 1*a*, 1*b* respectively, with the bosses 13, 14 projecting outside through the holes 7, endless chains 19 being wound around wheels 3, 4 between teeth 3*a*, 4*a*. The elements 1*a*, 1*b* are fixed by screwing bolts 20 in the holes 12 from the sides of the holes 11 for inserting bolts.

A cylindrical handle 21 is projectingly formed at the other end portion of the attachment P1 on the side of the wheel 4 upon having interconnected the casing elements 1*a*, 1*b*. That is, semi-cylindrical projections 21*a*, 21*b* are provided respectively on the elements 1*a*, 1*b*, the projections constituting mating halves that are joined to form the handle 21 when the two projections 21*a*, 21*b* are put together.

Figure 5:
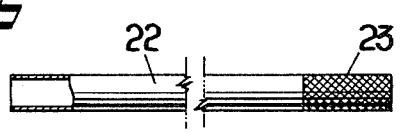
FIG. 5 is the external appearance of a lever of the inventive attachment, operating as reaction force receiving means.

In use of the attachment P1, the handle 21 is directly grasped by the operator, or a partly hollow lever 22 as shown in FIG. 5 can be put on the handle 21. The handle and the lever 22 form part of reaction force receiving means. The lever 22 is made for example of steel pipe, and to the outer end 23 thereof a knurling is applied to avoid slipping. In order to use the lever 22 the hollow end is slipped about the handle 21 while the knurled portion 23 is used as a grip.

Figure 4:
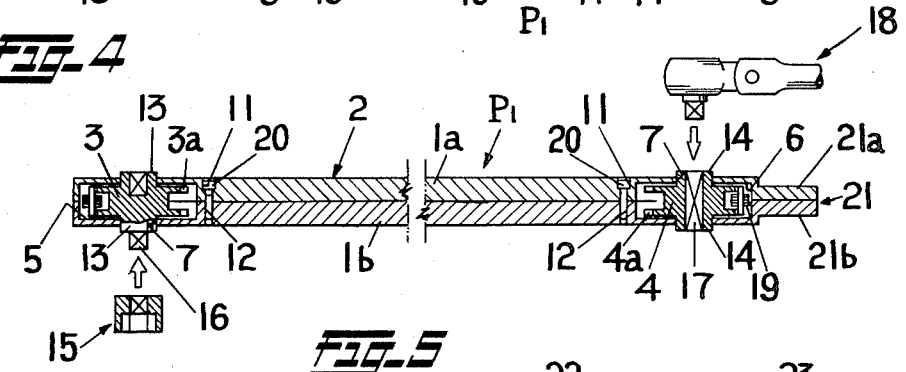
FIG. 4 is a longitudinal section taken in the direction of the arrows along the line IV—IV of FIG. 1.
Figure 6:
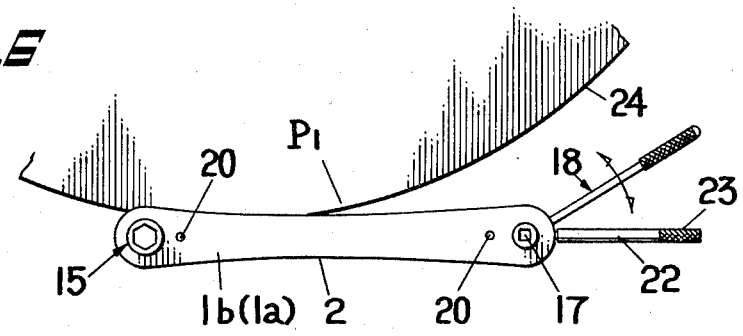
FIG. 6 shows an example of using the inventive attachment of FIGS. 1 to 5.
Figure 7:
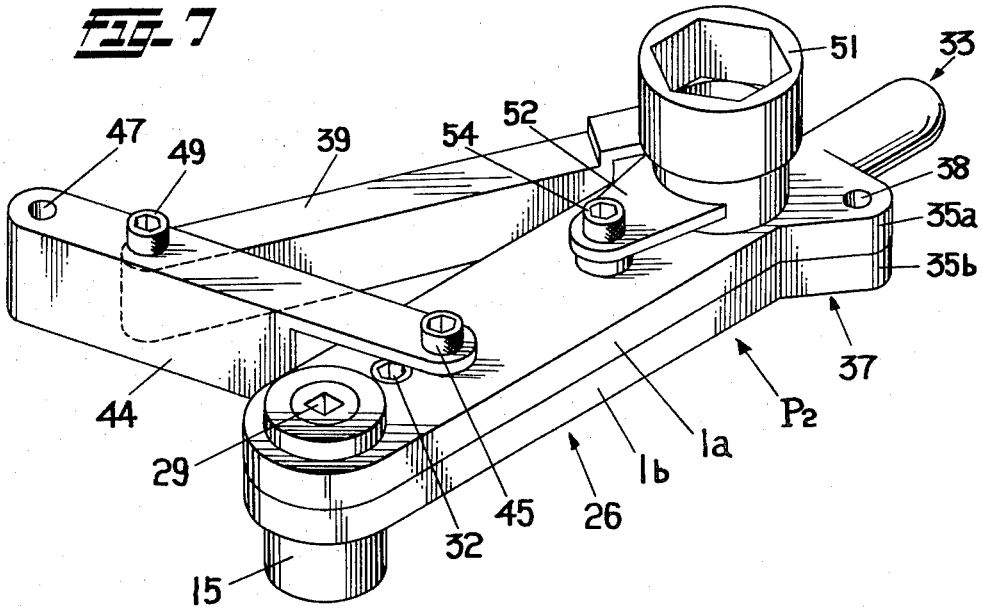
FIG. 7 shows the external appearance of a second embodiment of the inventive attachment.
Figure 8:
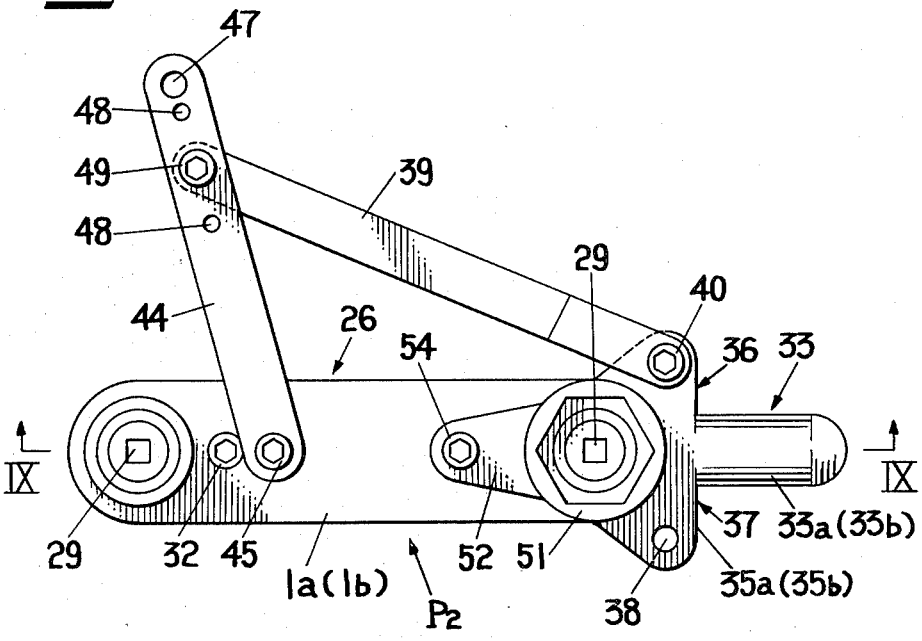
FIG. 8 is a top plan view of the same.

Now the use of the attachment of FIGS. 1 to 4 will be explained when a tightening or removing operation of a bolt or the like object is carried out at a joint of an underground pipe 24, as shown in FIG. 6. The socket 15 of the attachment is fitted on the shaft 16 at the end at which the wheel 3 of the attachment P1 is provided (see FIG. 4). Then the attachment is inserted through the narrow gap between the pipe 24 and the ground so that the socket 15 may grip the object such as the bolt in question. Thereafter, the lever 22 is attached to the handle 21 at the other end of the attachment P1 (chain wheel 4), and by holding the attachment with one hand through the lever 22, the wrench 18 is attached by making use of the hole 17 as shown in FIGS. 4 and 6. Then the torque wrench 18 is turned reciprocatively vertically with the other hand.

The socket 15 and the bolt or the like are now turned by transmitting the turning force applied to the wheel 4 to the other wheel 3 through the chain 19, and thereby the bolt is fastened or removed, depending on the direction of actuation. Consequently, there is no need of inserting the wrench 18 itself in the narrow gap and turning it, and by the use of the inventive attachment P1, it is possible to operate the wrench 18 in a relatively wide space outside the narrow gap.

Further, the reaction force generated in the attachment P1, as a result of the turning operation of the torque wrench 18 when the bolt is tightened or removed, is exactly received by the power of the operator because the turning operation of the torque wrench 18 is carried out in such a manner that the attachment is held with the other hand through the lever 22. Consequently the tightening or removing operation is carried out securely. It is of course possible to adjust the angle of inclination of the attachment P1 with reference to the narrow gap by the holding strength of the operator exerted on the lever 22.

A second exemplary P2 shown in FIGS. 7 to 10 has a structure wherein an automatic tightening and removing device 25 (FIG. 9), that makes use of the turning force of a motor, is applied, while the attachment P1 makes use of the torque wrench 18 that is manually operated. In this modified attachment P2 a casing 26 follows that of the first embodiment (with parts 1*a*, 1*b*), in which bosses 13, 14 are mounted projectingly on the end surfaces of chain wheels or sprockets 3, 4 respectively (see FIG. 9), inserted in boss bores 27. Square shafts 28 are projectingly formed to mount the socket 15 therein on one side of the bosses, square holes 29 being provided on the other end surface thereof, as clearly shown in FIG. 9. In other respects the inner structure of the attachment P2 is the same as that of P1, as has been described for FIGS. 1 to 4.

The wheels 3, 4 are mounted in the spaces between the recessed portions 5, 6 of the casing elements 1*a*, 1*b* respectively. Chains 19 are wound about wheels 3, 4, and thus the elements 1*a*, 1*b* are fixed into the single body or casing 26 by screwing bolts and nuts 32 in holes 30, 31. Numeral 33 denotes a handle which has the same structure as that of numeral 21 of the first embodiment and has projections 33*a*, 33*b* that are tightened by applying a bolt and a nut 34 (see FIG. 9).

Further, flanges 35*a*, 35*b* are provided on the side wall of casing 26 (FIGS. 7, 8), on which the wheel 4 (right) of elements 1*a*, 1*b*, and the flanges are put together when the latter are interconnected. Seats are formed for fitting stops 36, 37. Tapped holes 38 which go through the overlapped flanges 35*a*, 35*b* are formed in the seats, and a (bifurcate) end of a supporter 39 is fixable to either of the seats by screwing a bolt 40 and a nut 41 in one of the holes 38.

Figure 9:
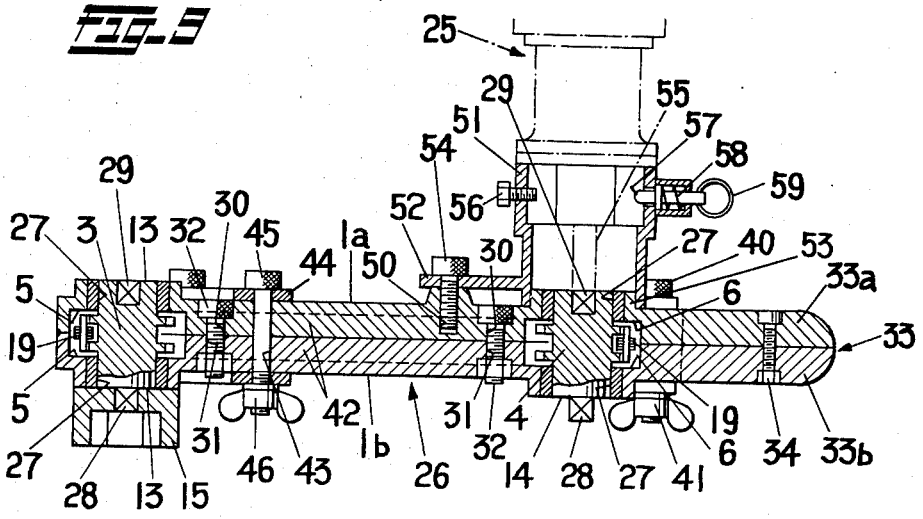
FIG. 9 is a section of the attachment of FIGS. 7, 8, taken along the line IX—IX of FIG. 8.

A hole 43 (FIG. 9) for inserting a bolt passes through the casing elements 1*a*, 1*b* at the wheel 3 (left) by making use of projecting strips 42 (which correspond to the strips 8 of the first embodiment) which serve as chain guides, and a (bifurcate) end of a lever 44 to receive the reaction force is fixed to the hole 43 by making use of a bolt 45 and a butterfly nut 46 (FIG. 9). The end of the lever 44 contacts a member positioned on the side where the bolts or the like are screwed in, and at this point a longitudinal hole 47 passes through the lever to attach a bolt and a nut therein as will be explained later.

A plurality of coupling holes 48 (shown in FIGS. 8, 12 but not in 7, 10, 11) passes at a position a little towards the hole 47 in the direction along the length of the lever 44. The outer end of the supporter 39 is connectable with any hole 48 by screwing in a bolt 49. It can thus be seen that the reaction force receiving means essentially consists of the lever 44 and the supporter 39.

A tapped hole 50 (see FIG. 9), provided in the casing element 1*a*, is to connect a coupling 51 for the earlier-mentioned device 25. In use, the coupling 51 as shown in FIGS. 7 to 10 is fitted on the casing 26 of the attachment P2, and the tightening and removing device 25 is connected firmly with the casing 26. A coupling stop member 52 is projectingly provided from the coupling 51, and the latter is fixed straight on the casing 26 by screwing a bolt 54 (again FIG. 9) in the hole 50 through the stop 52, with the coupling 51 mounted to a flange 53 in a coaxial relationship, which encircles one of the boss bores 27, on the side of the wheel 4.

A power shaft 55 (see FIG. 9) of the device 25, which passes through the coupling 51, is fitted in the hole 29 on the side of the wheel 4 by passing a setscrew 56 in the device 25 through the coupling 51. The grade of fixing the device 25 to the coupling 51 depends upon the setscrew 56 but in a case when the application of the fixing is uncertain, a lock pin 57 also shown in FIG. 9 may also be used. The lock pin 57 is permitted to dig into the coupling 51 by making use of a spring 58. The expected locking effect is realized by having the pin 57 recede by making use of a ring 59 to insert a finger therein, inserting the device 25 in the coupling 51, and engaging the pin 57 in a lock hole provided on the side of the device 25.

In this way, using the setscrew 56 together with the lock pin 57, fixing ability of increased. Accordingly a danger such as unexpected falling off or dropping of the device 25 is avoided even if the attachment P2 is used in a workshop, e.g. at a relatively high level.

Figure 10:
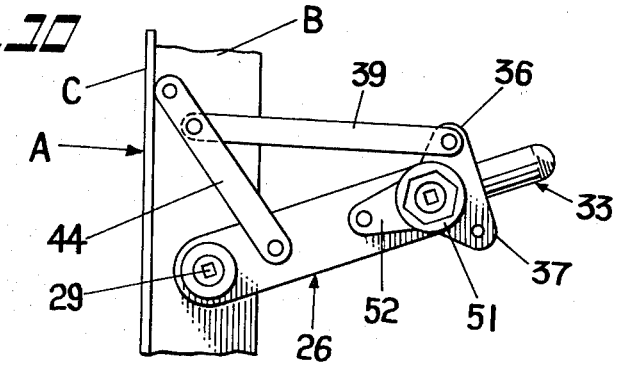
FIG. 10 shows an example of using the inventive attachment of FIGS. 7 to 9.
Figure 11:
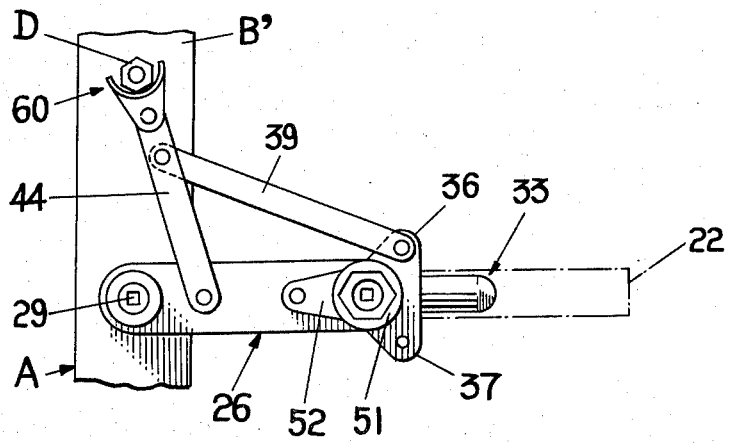
FIG. 11 shows a modification of the inventive attachment of FIGS. 7 to 10.
Figure 12:
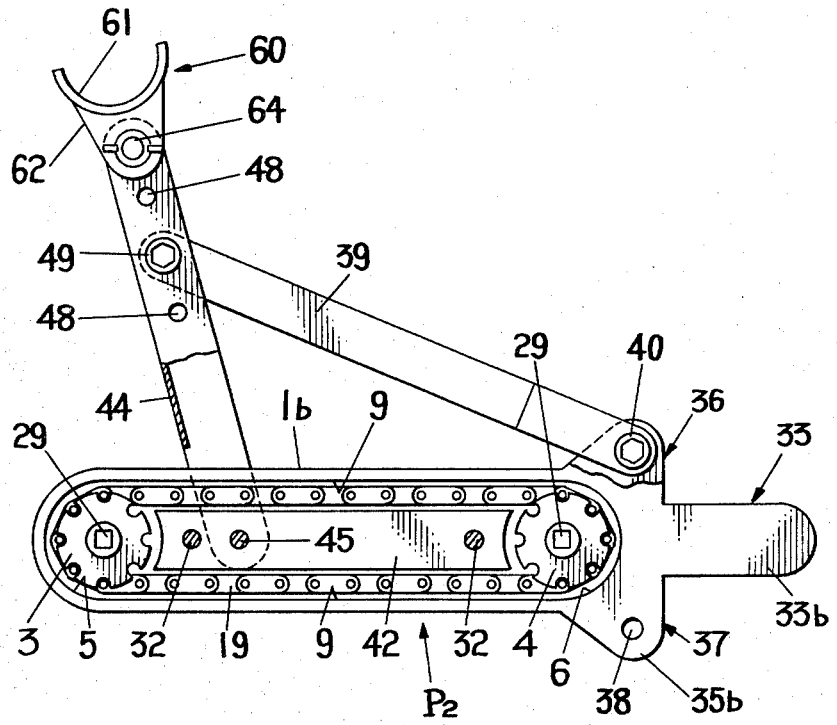
FIG. 12 is a partially cut away plan view of the modified attachment of FIG. 11, equipped with a bolt chuck.
Figure 13:
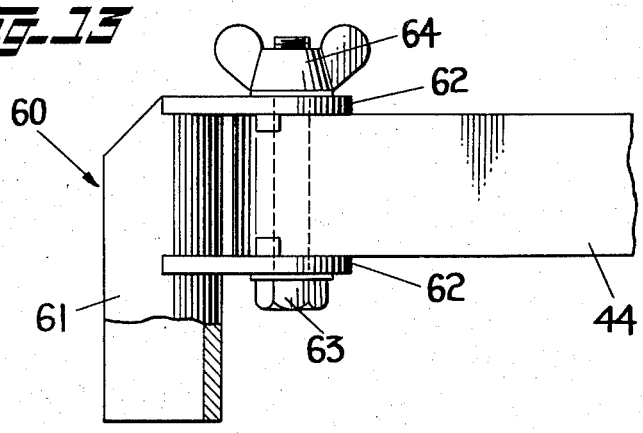
FIG. 13 is an enlarged view showing principal parts of the attachment of FIG. 12.

From now on, reference will be had to FIG. 10 and to a modification of the attachment P2 as shown in FIGS. 11 to 13. In the attachment P2, as seen hereinafter, in mounting or removing operations of the objects such as bolts and the like, the contacting end portion of the reaction force receiving lever 44 is pushed against a member A in which the objects are mounted, and the reaction force generated by the mounting or removing operation is received by that member.

Accordingly, as seen in FIG. 10, when the member A in which the bolt is attached has an upright wall C against a side wall B, the lever 44 may be directly pushed against the wall C.

To the contrary, as seen in FIG. 11, when a side wall B′ has no upright wall portion, the reaction force receiving lever 44 cannot be used by itself. In this case, a bolt and chuck nut (or nut and chuck) combination 60 whose detailed structure is shown in FIGS. 12 and 13 is mounted at the contacting portion of the lever 44 prior to the use of the attachment P2. The bolt and chuck nut 60 includes a semi-cylindrical engaging member 61 and bifurcate mounting pieces 62 provided on its rear side, the latter serving as clamping members for the end of the lever 44, which is held by fixing with the pieces 62, and a bolt 63 and a butterfly nut 64 mounted in the hole 47 (FIG. 8) and engaging the member 61 with an adjacent bolt D on the wall B′, which is replaceable with a projection.

As seen in FIG. 13, the member 61 is downwardly longer than the lever 44. This is because the member 61 can surely hold the adjacent bolt or projection (e.g. D), which is provided on the same side as the bolt when the socket 15 grasps the latter, which is the object to be tightened or removed, projecting the member 61 downwardly by a length to allow it to add the socket 15 to the shaft 28 of the wheel 3.

The socket 15 is connected to the shaft 28 of the wheel 3 (see FIG. 9), the attachment P2 is thus made to move on toward the member A through the narrow gap, the socket 15 is fitted to the bolt, and the end of the lever 44 is made to contact the upright wall C (FIG. 10) or the adjacent bolt D (FIG. 11) when held with the bolt/chuck combination 60.

Then the operator, grasping the handle 33 with one hand and starting the tightening and removing device 25 with the other hand, applies the turning force to the wheel 4 and transmits it to the other wheel 3 through the chain 19, and thereby the bolt or the like is fastened or removed. The reaction force exerted on the attachment P2, following a fastening operation, is transmitted to the wall C or the adjacent bolt D through the lever 44 and the supporter 39, and these parts receive the reaction force mentioned above by their rigidity. Accordingly, the operator can carry out the fastening or removing operation without the necessity of applying to the attachment P2 any force to resist the reaction force, keeping the attachment P2 in a stable position.

On the other hand, when the bolt is to be removed from the member A, the reaction force acting on the attachment P2 as well as the turning force exerted on the bolt works in the reverse direction to what has been explained so far, so that the operator should now remove the supporter 39 from the stop 36 and mount it to the other stop 37, and at the same time he should rearrange the lever 44 so as to be on the side of the stop 37. In this way it becomes possible to use the attachment for this reverse operation as well.

Though the reaction force comes to act on the tightening and removing device 25 when the wheel 4 is turned, by making use of the device 25, there is never any inconvenience to the rotation of the wheel 4 because the device 25 is fixed to the casing 26 of the attachment P2 through the coupling 51.

The coupling holes 48 provided in the lever 44 have the advantage of allowing a change in the angle of the attachment P2 when it is used as seen in FIGS. 10 and 11, by selectively connecting the supporter 39 with any of these holes. When it is difficult for the operator to grasp the handle 33 in the wide space outside the narrow gap, because the attachment P2 is shorter than the narrow gap, a lever 22 of the same structure as shown in FIG. 5 should be added to the handle 33 of this embodiment (as this was suggested for the handle 21 of the attachment P1).

It will be understood by those skilled in the art that features disclosed for the first and second embodiments are interchangeably and selectively useable for the other embodiment as well, and that additions, modifications, omissions and the like expedients can be applied to the disclosed embodiments as well as to their variants, still within the scope of the present invention.

What I claim is:

1. An attachment (P1; P2) for a tightening and removing device (18; 25) for objects such as bolts, nuts and the like, comprising: an elongated casing (2; 26); an input shaft (14; 28) journaled at one end of said casing for attaching said tightening and removing device; a chain wheel (4) lodged in said casing and formed integrally with said input shaft; an output shaft (16; 28) journaled at the other end of said casing for attaching a socket (15) that serves to grip the objects; a second chain wheel (3) lodged in said casing and formed integrally with said output shaft; an endless chain (19) lodged longitudinally in and along said casing for interconnecting said wheels; reaction force receiving means (21, 22; 33, 39, 44) provided in said casing, said reaction force receiving means (33, 39, 44) including a reaction force receiving lever (44) whose rear end is attached (45) to said casing (26) in such a manner that the free end thereof serves to contact the objects; and means (36, 37, 40) for selectively attaching a supporter (39) to said casing (26) and for selectively projecting said reaction force receiving lever (44) to either side of said casing, towards the outside of said output shaft (28), according to the direction in which the reaction force is made to work.

2. The attachment as defined in claim 1, further comprising a handle (21; 33) provided projectingly from said one end of the casing (2; 26) and formed integrally with the same.

3. The attachment as defined in claim 2, wherein said handle (21; 33) has an elongated lever (22) removably added thereto.

4. The attachment as defined in claim 1, wherein said casing (26) includes on the side of said input shaft (28) a coupling (51) for connecting said tightening and removing device (25), which coupling is removable and coaxial with said input shaft on the outer periphery of said casing.

5. The attachment as defined in claim 1, further comprising a bolt chuck (60) for holding the objects, removably provided at said free end of the reaction force receiving lever (44).

6. The attachment as defined in claim 1, wherein said reaction force receiving lever (44) is connected (49) with the supporter (39), also included in said reaction force receiving means (33, 39, 44), and removably journaled (40) on said casing (26).

7. The attachment as defined in claim 6, further comprising means (48) for selectively changing the point of said connection (49) between said reaction force receiving lever (44) and said supporter (39) longitudinally along said lever.

8. The attachment as defined in claim 1, wherein said selective attaching and projecting means (36, 37, 40) includes seats (36, 37) on said casing (26) for selectively attaching said supporter (39), said seats extending at the ends on the side of said input shaft (28).

* * * * *